US006059125A

United States Patent [19]

Parham

[11] Patent Number: 6,059,125

[45] Date of Patent: May 9, 2000

[54] BOTTLE NECK-HANGING MERCHANDISING DEVICE HAVING INTEGRAL SPACERS

[75] Inventor: Dennis E. Parham, Kennesaw, Ga.

[73] Assignee: Display Industries, LLC., Smyrna, Ga.

[21] Appl. No.: 09/013,013

[22] Filed: Jan. 26, 1998

[51] Int. Cl.[7] ..... A47F 1/06; A47B 73/00

[52] U.S. Cl. ..... 211/59.2; 211/74; 211/162; 312/321

[58] Field of Search ..... 211/59.2, 74, 162, 211/49.1, 113; 312/321; 403/361

[56] References Cited

U.S. PATENT DOCUMENTS

| | | | |
|---|---|---|---|
| 1,611,036 | 12/1926 | Hovda | 209/677 |
| 2,218,444 | 10/1940 | Vineyard | 211/59.2 |
| 2,311,449 | 2/1943 | Lilly | 211/113 X |
| 2,327,379 | 8/1943 | Thomas | 211/74 |
| 2,332,214 | 10/1943 | Forsthoefel et al. | 211/113 X |
| 2,620,691 | 12/1952 | Gould | 211/113 X |
| 3,160,278 | 12/1964 | Varkala | 211/74 |
| 3,243,220 | 3/1966 | Karas | 211/113 X |
| 3,298,763 | 1/1967 | Di Domenico | 211/59.2 |
| 3,306,688 | 2/1967 | Di Domenico | 211/59.2 |
| 3,553,927 | 1/1971 | Anglade, Jr. | 211/113 X |
| 4,019,638 | 4/1977 | Miller | 211/113 |
| 4,022,363 | 5/1977 | Eliassen | 294/87.2 |
| 4,228,905 | 10/1980 | Cammarota | 211/41.2 |
| 4,310,097 | 1/1982 | Merl | 211/59.2 |
| 4,318,485 | 3/1982 | Clement | 211/59.2 |
| 4,367,818 | 1/1983 | Suttles | 211/59.2 |
| 4,401,221 | 8/1983 | Suttles | 211/59.2 |
| 4,775,058 | 10/1988 | Yatsko | 211/184 |
| 4,830,201 | 5/1989 | Breslow | 211/184 |
| 4,909,401 | 3/1990 | McConnell | 211/74 |
| 4,997,094 | 3/1991 | Spamer et al. | 211/59.2 |
| 5,024,336 | 6/1991 | Spamer | 211/59.2 |
| 5,209,358 | 5/1993 | Simard | 211/74 |
| 5,531,336 | 7/1996 | Parham et al. | 211/59.2 |
| 5,586,665 | 12/1996 | Brousseau | 211/59.2 |
| 5,586,687 | 12/1996 | Spamer et al. | 221/298 |
| 5,695,074 | 12/1997 | Wiese | 211/74 |
| 5,695,075 | 12/1997 | Flum et al. | 211/74 |
| 5,706,956 | 1/1998 | Headrick et al. | 211/59.2 |
| 5,706,957 | 1/1998 | Hardy | 211/59.2 |
| 5,718,341 | 2/1998 | Robertson | 211/59.2 |
| 5,755,341 | 5/1998 | Spamer | 211/74 |
| 5,785,189 | 7/1998 | Gollob et al. | 211/74 |
| 5,836,460 | 11/1998 | Brown et al. | 211/74 |

FOREIGN PATENT DOCUMENTS

| | | | |
|---|---|---|---|
| 66005 | 12/1982 | European Pat. Off. | 211/74 |
| 1093283 | 2/1954 | France | 211/74 |

*Primary Examiner*—Daniel P. Stodola
*Assistant Examiner*—Jennifer E. Novosad
*Attorney, Agent, or Firm*—Tsugihiko Suzuki; John L. James

[57] ABSTRACT

A merchandising device comprises first and second elongated parallel tracks arranged side by side, and a spacer for maintaining a space between the first and second tracks. Each track includes a pair of spaced parallel rails for suspending a row of bottles therefrom such that said bottles in said row are slidably engaged with said rails for movement along that track and are removable from that track through its front end. The spacer comprises a first limb integrally formed with the first track and extending to the second track.

10 Claims, 3 Drawing Sheets

BOTTLE NECK-HANGING MERCHANDISING DEVICE HAVING INTEGRAL SPACERS

BACKGROUND OF THE INVENTION

This invention relates to merchandising display devices for bottles such as soft drink bottles, and particularly to a neck-hanging type bottle dispensing device in which bottles are suspended by their neck flanges and carried forward by gravity on a plurality of spaced parallel tracks.

Neck-hanging type display devices have been used in the merchandising of soft drink bottles such as PET bottles having outwardly projecting annular neck flanges. These devises have a plurality of elongated tracks mounted on a support frame on which the tracks are arranged side by side in a spaced parallel relationship. Each track has a pair of parallel rails extending along that track. The necks of flanged bottles are received between the rails of each track so that the bottles are engaged at their neck flanges with the rails and thus suspended from the respective track. The bottles received in each track are automatically arranged in a tidy row along the respective track and presented for removal by customers through the front end of the respective track.

The distance between adjacent tracks are great enough to prevent interference between the bottles suspended from the adjacent tracks. To assure such a distance, it is typical that separate spacers are positioned between the adjacent tracks. These separate spacers, however, are inconvenient in order to perform efficient assembly of the devices not only because they tend to be lost but also because they must be positioned one by one at certain locations between adjacent tracks.

What is needed, therefore, is a neck-hanging type display device which is easy to assemble and yet is capable of assuring the precise distance between adjacent tracks.

SUMMARY OF THE INVENTION

The present invention provides a merchandising device which comprises first and second elongated parallel tracks arranged side by side, and spacer means for maintaining a space between the tracks. Each track includes suspension means for suspending a row of bottles therefrom such that the bottles in the row are slidably engaged with the suspension means for movement along each track and are removable from each track through its front end. The spacer means comprises a first limb integrally formed with the first track and extending to the second track.

When the tracks are arranged side by side, the integral spacer means automatically provides a preset distance between the tracks. Thus, without any subsequent adjustment for a proper track distance, one can easily preset the width of a shelf unit that is eventually assembled from the tracks. This considerably facilitates the assembly of the merchandising device. Further, the mere side-by-side arrangement can confirm that a final form of the shelf unit will have a proper width which fits a certain support frame such as an existent frame in a retail store.

According to a preferred embodiment of the invention, the first track and the first limb are molded together from moldable material such as plastic, aluminum or the like into a unitary structure.

According to another preferred embodiment, the spacer means further comprises coupling means on the second track for engagement with the first limb. The coupling means prevents relative displacement of the first and second tracks along a vertical plane parallel to the lengths of the tracks. A preferred form of the coupling means is a second limb integrally formed with the second track whereby the second limb extends to the first limb to be disposed in an end-to-end engaging relationship with the first limb. The second limb may have a recess for receiving the free end of the first limb.

According to a further preferred embodiment, each track comprises a pair of side walls interconnected by a top wall so as to form a channel structure, and the first limb is joined to one of the side walls of the first track to project laterally from the one side wall. The spacer means may further comprise a second limb joined to one of the side walls of the second track and extending to said first limb to be disposed in an end-to-end engaging relationship with the first limb.

In a still further preferred embodiment, the spacer means comprises a plurality of first limbs arranged along the length of said first track.

BRIEF DESCRIPTION OF THE DRAWINGS

In the drawings,

in FIG. 3 showing the second limb at a different view angle.

DETAILED DESCRIPTION OF THE PREFERRED EMBODIMENT

Figure 1:
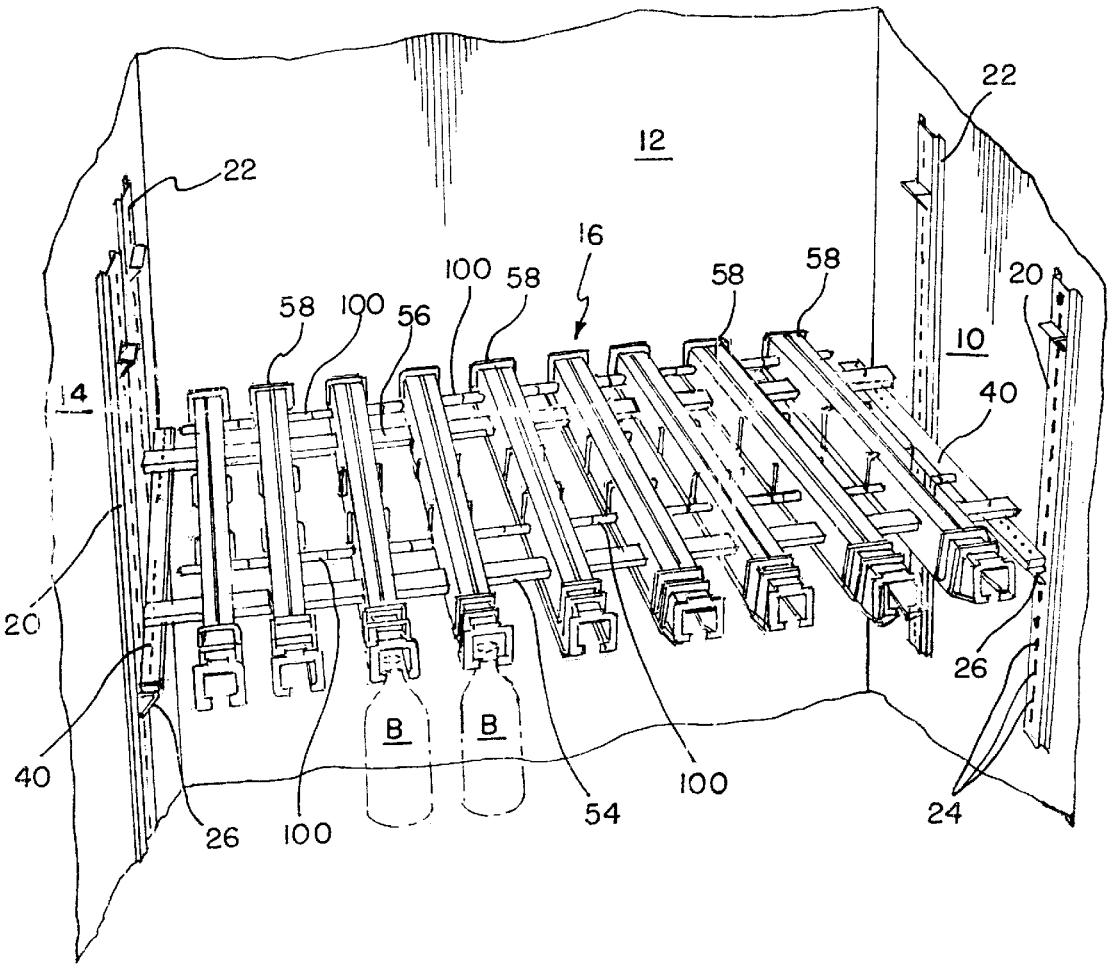
FIG. 1 is a perspective view of a neck-hanging type bottle-dispensing device according to the invention, which device is installed in a display cooler/refrigerator.

FIG. 1 illustrates a neck-hanging type merchandising device according to the invention. The illustrated device, more particularly, is a gravity feed bottle-dispensing device wherein the suspended bottles "B" are carried forward by gravity as the leading or foremost bottles are dispensed successively from the device. The device is installed inside a single-door cooler/refrigerator and is shown as viewed from the front side of the cooler. The door of the cooler is omitted for illustration purpose; however, such a door, a glass door preferably, is hinged to the cooler housing to close the front opening of the cooler. Reference numerals 10, 12 and 14 denote the inside walls of the cooler.

The device comprises a support frame on which a shelf unit 16 is removably mounted. The support frame may be any conventional structure for supporting shelves at elevated positions above a floor. The support frame shown in FIG. 1 includes a conventional four-post structure having been built into the cooler. The four-post structure comprises two pairs of front and rear uprights 20 and 22. The uprights 20 and 22 of each pair are disposed alongside the respective one of the opposed inside walls 10 and 14 and secured to the same by suitable fastening means such as screws, rivets or the like. The four uprights 20 and 22 are of a substantially identical structure formed with a number of engaging slots 24. The slots 24 of each upright 20 and 22 are arranged in a vertical row at equal spacings.

The illustrated support frame also includes four conventional snap-in supporting brackets 26, and a pair of opposed adapter members 40 each extending between the front and rear uprights 20 and 22 of the respective pair. Details of the brackets 26 and the adapter members 40 are described in copending U.S. patent application Ser. No. 08/794,943 which is hereby incorporated by reference.

In FIG. 1, only one shelf unit 16 is shown as being mounted on the support frame. However, more than one shelf unit 16 will in general be mounted in a tiered relationship. Each shelf unit 16 has two or more (typically five to nine) substantially parallel elongated tracks 58 interconnected through a pair of front and rear transverse support members 54 and 56. The opposite ends of the transverse members 54 and 56 are secured to the opposed adapter members 40 so that the tracks 58 extend parallel to the adapter members 40 with their forward ends disposed between th(e front uprights 20 and 20. The number of the tracks 58 used to assemble the shelf unit 16 is determined such that the width of the shelf unit 16 is suitable for placement on the support frame as the frame defines a predetermined distance between the pairs of the uprights 20 and 22. The tracks 58 are virtually identical to each other, and so are the front and rear transverse members 54 and 56. Accordingly, the details will hereinafter be described regarding primarily one of the tracks 58 and the front transverse member 54.

The transverse member 54 may be formed of metal or plastic and preferably of metal. The member 54 is designed to be removably mounted on the aforementioned support frame so that the shelf unit 16 can be held at a desired elevation. The transverse member 54 is of a tubular construction having a generally rectangular cross section. The upper wall of the transverse member 54 is formed with a plurality of retaining apertures (not shown) arranged along the length of the member 54 at equal spacings.

Figure 3:
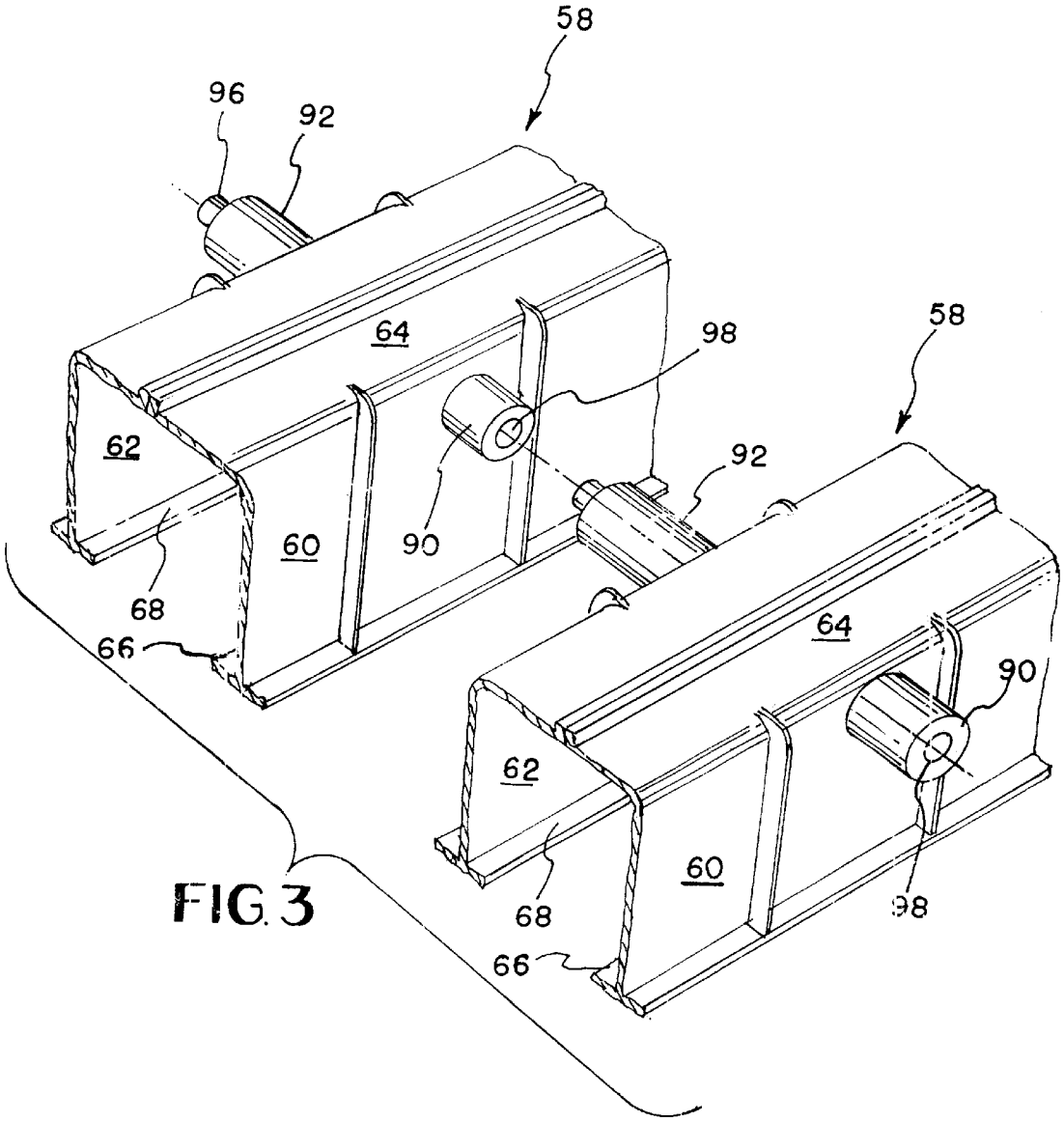
FIG. 3 is an exploded fragmentary perspective view of the two tracks in FIG. 2, showing the first and second limbs disengaged from each other.

The tracks 58 may be formed of metal or plastic and preferably of molded plastic. As best illustrated in FIG. 3, each track 58 has a pair of longitudinally extending opposed side walls 60 and 62 joined together along their upper edges by a top wall 64. The side walls 60 and 62 and the top wall 64 in cooperation form a channel structure having an inverted U-shaped cross section. Suspension means in the form of a pair of elongated parallel rails 66 and 68 are joined to and disposed along the lower edges of the side walls 60 and 62 respectively and project inwardly of the respective track 58. A space is maintained between the rails 66 and 68 to receive therein the necks of flanged bottles such as PET bottles. The distance between the rails 66 and 68 is such that when bottle necks are received between the rails 66 and 68, the bottles are automatically arranged in a row and the undersides of the neck flanges engage the rails 66 and 68 to allow the bottles to be suspended for sliding movement along the respective track 58. The shelf unit 16 is held by the frame such that each track 58 is inclined to its front end, and thus the suspended bottles gravity feed one after another to the front end of the respective track 58 as the leading bottles on that track successively are removed through the front end. Reaching the front end, the bottles are braked to a stop by a stopper and presented for removal by customers.

Figure 2:
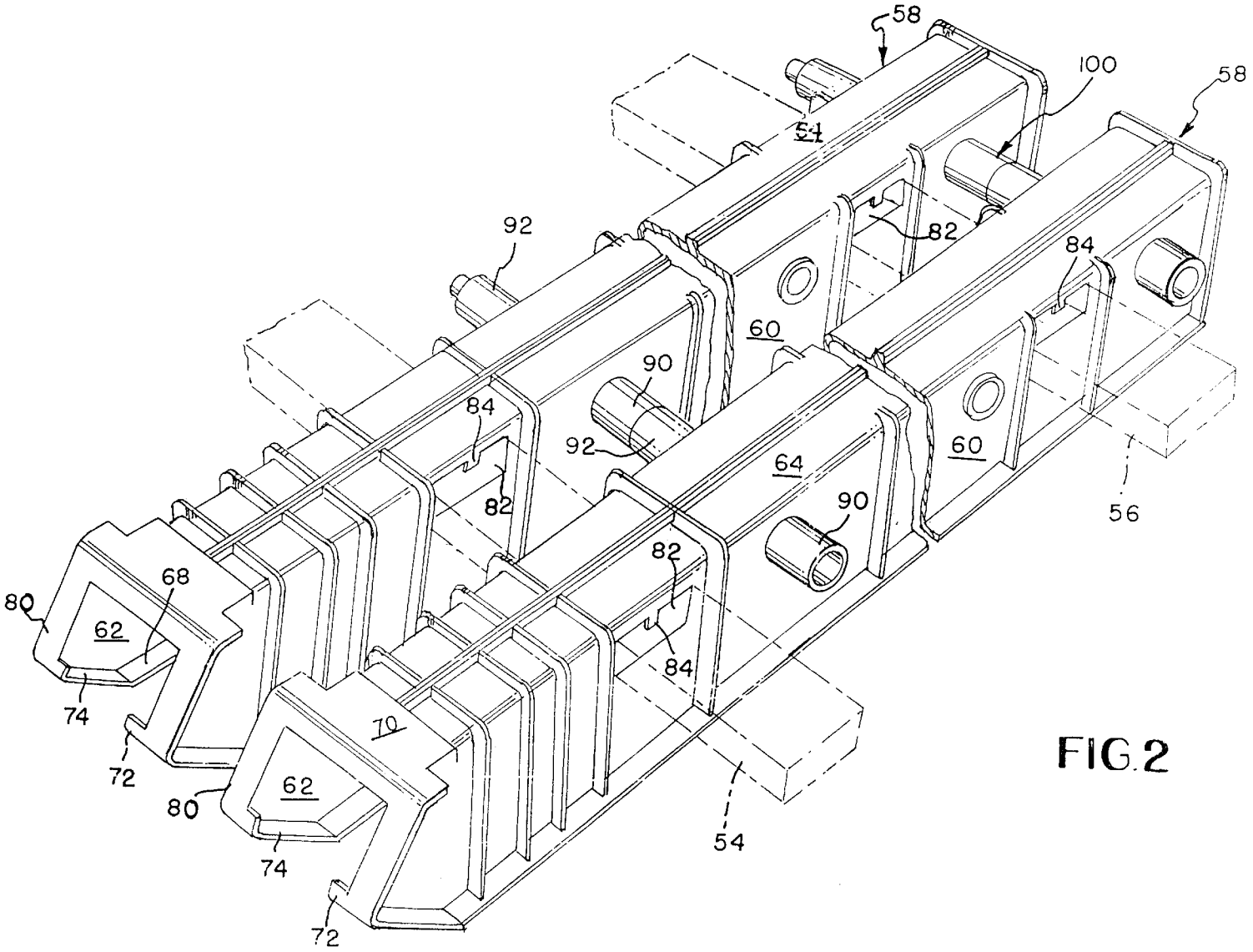
FIG. 2 is an enlarged fragmentary perspective view of two of the tracks in FIG. 1, showing first and second limbs coupled together to form a spacer.

The stopper is denoted by reference numeral 70 in FIG. 2 and is provided at the front end of each track 58. The stopper 70 comprises a length of the respective track 58 adjacent to its front end. Such a length is upturned relative to the immediately preceding length of the respective track 58 to provide forwardly upturned portions 72 and 74 of the rails 66 and 68. The stopper 70 is described in more detail in copending U.S. patent application Ser. No. 08/878,161 which is hereby incorporated by reference.

As shown in FIG. 2, the side walls 60 and 62 of each track 58 are provided with a pair of opposed generally rectangular apertures 82 near each track end. These apertures 82 receive the transverse members 54 and 56 so that the respective track 58 is supported at its front and rear end portions by the transverse members 54 and 56. The size of th(s apertures 82 is such that the apertures 82 allow the respective track 58 to slide along the transverse members 54 and 56. A tab 84 projects downwardly from the perimeter of each aperture 82. This tab 84 is provided to be received in the aforementioned retaining apertures in the transverse members 54 and 56 to lock the respective track 58 in a desired position along the transverse members 54 and 56.

Figure 4:
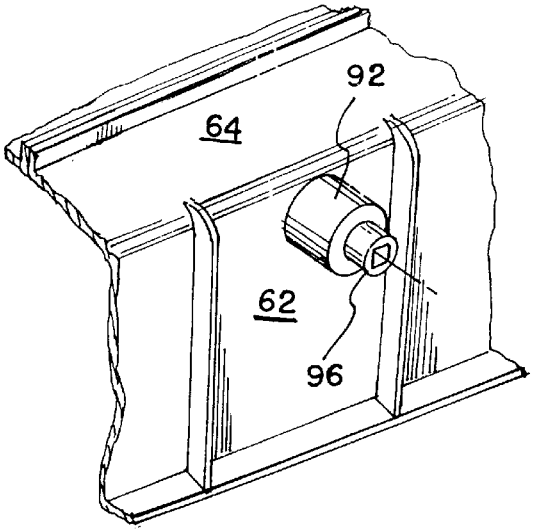
FIG. 4 is a fragmentary perspective view of one of the tracks.

Referring to the disassembled form in FIG. 3, each track 58 is formed integrally with pairs of cylindrical limbs 90 and 92. The female limbs 90 project laterally outwards from the side wall 60 of the respective track 58 whereas this male limbs 92 project laterally outwards from the other side wall 62. These limbs 90 and 92 are arranged such that the limbs of the same gender are disposed along the length of the respective track 58 and each pair of the limbs having opposite genders are aligned transversely of that track 58. The free end of each male limb 92 is formed by a smaller diameter portion 96 (shown in FIGS. 3 and 4) while each female limb 90 is formed at its end face with a cylindrical recess 98.

To assemble the merchandising device, the tracks 58 of a suitable number are placed side by side on a floor or any other available flat support surface. The female limbs 90 of each track 58 are coupled respectively to the male limbs 92 of the adjacent track 58 so that each coupled pair of male and female limbs 92 and 90 are in an end-to-end engaging relationship with each other. This coupling is achieved by inserting the free ends 96 of the male limbs 92 into the recesses 98 of the female limbs 90, respectively. The limbs 90 and 92 of each coupled pair create a spacer 100 between the respective tracks 58 as shown in FIGS. 1 and 2. The recess 98 of each female limb 90 snugly receives the free end 96 of the mating male limb 92 so that the respective tracks 58 are prevented from relative displacement along a vertical plane parallel to the lengths of the tracks 58. As a result, the tracks 58 are arranged neatly at predetermined spacings, providing a width of the arrangement exactly the same as that of the expected final form of the shelf unit. Subsequently, the front and rear transverse members 54 and 56 are inserted through the tracks 58 to connect them together into the shelf unit 16. Because the distance/spacing between adjacent tracks 58 is preset, no additional spacing adjustment is required. The assembled shelf unit 16 is then mounted on the support frame whereby the merchandising device is constructed.

In the foregoing embodiment, it is preferred that each track 58 and the associated limbs 90 and 92 are molded together as a unitary structure. However, the limbs may be formed separately as discrete members and may be secured to each track by means, for example, of adhesive, screws, rivets, welding or the like.

In place of the female limbs 90, apertures or indentations may be formed in the side wall 60 to receive the free ends 96 of male limbs 92. In this arrangement, the male limbs 92 may be substantially lengthened to maintain proper track spacings.

The support frame useful in the invention is not limited to the four-post structure as described in the foregoing embodiment but includes the four-post rack shown in U.S. Pat. No. 5,706,958, and a support assembly shown in copending U.S. application Ser. No. 08/684,357, which patent and application are hereby incorporated by reference. Another useful support frame may be composed of a base having a vertically extending back wall on which unit-supporting arms are cantilevered.

Further, the merchandising device of the invention is not limited to those for use in cold vaults but includes those for use in warm vaults.

What is claimed is:

1. A merchandising device comprising:

first and second elongated parallel tracks arranged side by side with a space therebetween, each of said tracks including suspension means for vertically suspending therefrom a row of bottles by neck rings of said bottles such that said bottles in said row are slidably engaged with said suspension means for movement along said each track and are removable from said each track through a front end of said each track; and spacer means for maintaining said space between said first and second track, said spacer means comprising a first limb integrally formed with said first track and extending to said second track, said spacer mean s further comprising coupling means on said second track for engagement with said first limb to prevent relative displacement of said first and second tracks along a vertical plane parallel to lengths of said tracks.

2. The merchandising device according to claim 1, wherein said first track and said first limb are molded together as a unitary structure.

3. The merchandising device according to claim 1, wherein said coupling means comprises a second limb integrally formed with said second track and extending to said first limb to be disposed in an end-to-end engaging relationship with said first limb.

4. the merchandising device according to claim 3, wherein said second limb has a recess for receiving a free end portion of said first limb.

5. The merchandising device according to claim 3, wherein said second track and said second limb are molded together as a unitary structure.

6. A merchandising device comprising:

first and second elongated parallel tracks arranged side by side with a space therebetween, each of said tracks including suspension means for vertically suspending therefrom a row of bottles by neck rings of said bottles such that said bottles in said row are slidably engaged with said suspension means for movement along said each track and are removable from said each track through a front end of said each track, said each track comprises a pair of side walls interconnected by a top wall so as to form a channel structure; and spacer means for maintaining said space between said first and second tracks, said spacer means comprising a first limb integrally formed with said first track and extending to said second track, and a second limb integrally formed with said second track, said first limb being joined to one of said side walls of said first track and projecting laterally from said one side wall said second track and engaging said first limb.

7. The merchandising device according to claim 6, wherein said spacer means further comprises a second limb joined to one of said side walls of said second track and extending to said first limb to be disposed in an end-to-end engaging relationship with said first limb.

8. The merchandising device according to claim 7, wherein said second limb has a recess for receiving a free end portion of said first limb.

9. A merchandising device comprising:

first and second elongated parallel tracks arranged side by side with a space therebetween, each of said tracks including suspension means for vertically suspending therefrom a row of bottles by neck rings of said bottles such that said bottles in said row are slidably engaged with said suspension means for movement along said each track and are removable from said each track through a front end of said each track;

spacer means for maintaining said space between said first and second tracks, said spacer means comprising a plurality of first limbs integrally formed with said first track and extending to said second tracks, and a corresponding plurality of second limbs integrally formed with said second track and extending to said first track; and a pair of front and rear transverse members extending generally perpendicularly to said tracks for connecting said tracks together.

10. A merchandising device comprising:

first and second elongated parallel tracks arranged side by side with a space therebetween, each of said tracks including suspension means for vertically suspending therefrom a row of bottles by neck rings of said bottles such that said bottles in said row are slidably engaged with said suspension means for movement along said each track and are removable from said each track through a front end of said each track;

at least one transverse member extending generally perpendicularly to said tracks to connect said tracks together, said each track comprising means for movably connecting said each track to said at least one transverse member for sliding movement along said at least one transverse member; and spacer means for maintaining said space between said first and second tracks, said spacer means comprising a first limb integrally formed as a uniting piece with said first track and extending to said second track.

* * * * *